US007882817B2

(12) United States Patent
Yamazaki

(10) Patent No.: US 7,882,817 B2
(45) Date of Patent: Feb. 8, 2011

(54) ENGINE STARTING SYSTEM AND METHOD

(75) Inventor: Masaki Yamazaki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 366 days.

(21) Appl. No.: 12/228,353

(22) Filed: Aug. 12, 2008

(65) Prior Publication Data

US 2009/0056665 A1 Mar. 5, 2009

(30) Foreign Application Priority Data

Aug. 28, 2007 (JP) ..... 2007-221155

(51) Int. Cl.
*F02N 1/00* (2006.01)

(52) U.S. Cl. ..... 123/185.3; 123/185.2

(58) Field of Classification Search ..... 123/185.1, 123/185.14, 185.2, 185.3, 406.53, 406.76, 123/491, 176.5, 179.16
See application file for complete search history.

(56) References Cited

U.S. PATENT DOCUMENTS 5,564,378 A * 10/1996 Rodriguez ..... 123/185.3
5,816,221 A * 10/1998 Krueger ..... 123/491
2004/0050368 A1* 3/2004 Kitagawa et al. ..... 123/480
2007/0028898 A1* 2/2007 Namari et al. ..... 123/491

FOREIGN PATENT DOCUMENTS

JP 54057039 A * 5/1979
JP 2005-155375 6/2005

OTHER PUBLICATIONS

English Abstract of JP 54057039 A.*

* cited by examiner

*Primary Examiner*—Stephen K Cronin
*Assistant Examiner*—Anthony L Bacon
(74) *Attorney, Agent, or Firm*—Carrier Blackman & Associates, P.C.; William D. Blackman; Joseph P. Carrier

(57) ABSTRACT

An engine starting system includes a recoil starter with a recoil rope having a mark formed thereon, defining a predetermined length of the recoil rope required to turn a crankshaft from a compression stroke top dead center position to a start-operation-initiating position suitable to start operation of a 4-stroke engine. A method of starting a 4-stroke engine includes steps of pulling the recoil rope to turn a crankshaft to an initial position where a piston is located near a compression stroke top dead center; pulling the recoil rope again to the position of the mark on the rope, to rotate the crankshaft from the initial position to a start-operation-initiating position; and pulling the recoil rope once again to further turn the crankshaft from the start-operation-initiating position suitable for starting the engine.

20 Claims, 11 Drawing Sheets

ENGINE STARTING SYSTEM AND METHOD

CROSS-REFERENCE TO RELATED APPLICATIONS

The present application claims priority under 35 USC §119 based on Japanese patent application No. 2007-221155, filed on Aug. 28, 2007. The entire subject matter of this priority document is incorporated by reference herein.

BACKGROUND OF THE INVENTION

1. Field of the Invention

The present invention relates to an engine starting system and method. More particularly, the present invention relates to an engine starting system and method for starting a 4-stroke engine using a recoil starter.

2. Description of the Background Art

It is known that some engines mounted on buggy vehicles, all-terrain vehicles or the like, or some engines for agricultural implements are provided with a recoil starter, and such engines are started by pulling a recoil rope, which is generally performed by a user.

An example of such known engine provided with a recoil starter is disclosed in Japanese Laid-Open Patent No. 2005-155375.

According to the Japanese Laid-Open Patent No. 2005-155375, the engine provided with a recoil rope obtains electric power from a generator rotated during the start operation of a recoil starter. An ignition operation is performed by the electric power thus obtained from the generator. If an electronic fuel injector is provided, fuel supply is performed by the electric power thus obtained. The engine starting system disclosed in the Japanese Patent Laid-Open No. 2005-155375 exercises ignition control by selecting optimum ignition timing from an ignition map in which ignition timing is set relative to the rotational speed of an engine.

The engine starting system disclosed in the Japanese Patent Laid-Open No. 2005-155375 exercises ignition control by selecting the optimum ignition timing. However, the time when start operation is initiated, i.e., a crankshaft rotational position encountered when the recoil rope is started to be pulled, is not controlled.

In other words, according to the engine starting system of the Japanese Patent Laid-Open No. 2005-155375, the rotation is started from crankshaft rotational positions different each time. Thus, starting performance of the engine has variations, which may result in inefficient and difficult starting of the engine.

The present invention has been made in view of the above-mentioned drawbacks. Accordingly, it is it is one of the objects of the present invention to provide an engine starting system and method that can improve the starting performance of an engine equipped with a recoil starter for easily starting the engine.

SUMMARY OF THE INVENTION

In order to achieve the above objects, the present invention according to a first aspect thereof provides an engine starting system having a 4-stroke engine including a piston and a crankshaft; a recoil starter having reel, and a recoil rope wound around the reel, the recoil starter is connected to the crankshaft via a ratchet mechanism for transmitting only one-directional turn; a generator for generating electric power in conjunction with the turn of the crankshaft; and an ignition device controlled by a control unit using the electric power outputted by the generator as a power supply to generate a spark in the vicinity of compression stroke top dead center of the piston.

The 4-stroke engine is started by pulling the recoil rope to turn the crankshaft. The engine starting system further includes notifying unit for notifying a length of the recoil rope required to turn the crankshaft from the turning position of the crankshaft encountered when the piston is located in the vicinity of the compression stroke top dead center to a turning position of the crankshaft adapted to initiate start operation of the 4-stroke engine.

The present invention according to a second aspect thereof, in addition to the first aspect, is characterized in that the notifying unit is a mark provided on the recoil rope at a length-position required to turn the crankshaft from a near-tip of the recoil rope in order to displace the piston from the vicinity of the compression stroke top dead center to the next exhaust stroke top dead stroke.

The present invention according to a third aspect thereof, in addition to one of the first and second aspects, is characterized in that the engine starting system includes a fuel injector for injecting fuel into the 4-stroke engine; and the control unit controls the fuel injector and the ignition device so that, after start operation of the 4-stroke engine is initiated, the fuel injector injects and supplies fuel to the 4-stroke engine at a predetermined position of the piston in preparation for ignition in the vicinity of the next compression stroke top dead center.

The present invention according to a fourth aspect thereof provides a method of starting a 4-stroke engine having a piston and a crankshaft. The method involves the steps of setting an initial position of the crankshaft; generating electric power by a generator in conjunction with turn of the crankshaft; and controlling an ignition device by a control unit using the electric power outputted by the generator as a power supply to generate a spark in the vicinity of a compression stroke top dead center position of the piston. The engine is started by turning the crankshaft, and the method hereof includes additional steps of setting an initial position of the crankshaft at a turning position of the crankshaft where the piston is located in the vicinity of the compression stroke top dead center; a start preparation step including turning the crankshaft from the initial position to a start operation initiating position so that the piston is displaced from the vicinity of the compression stroke top dead center to the next top dead center; and a start step of further turning the crankshaft from the start operation initiating position to cause the generator to generate electric power, supplying fuel to the engine, and allowing the ignition device to ignite the fuel.

EFFECTS OF THE INVENTION

According to the first aspect of the present invention, the engine starting system includes the notifying unit for notifying the length of the recoil rope required to turn the crankshaft from the turning position of the crankshaft encountered when the piston is located in the vicinity of the compression stroke top dead center to a turning position of the crankshaft adapted to start pulling the recoil rope in order to initiate start operation of the 4-stroke engine. Thus, before the start operation of the engine, the crankshaft is previously turned to the turning position encountered when the piston is located at the compression stroke top dead center and the recoil rope is operatively pulled to a position corresponding to such a length. This can turn the crankshaft to the start operation initiating position suitable to initiate the start operation for the engine. If the recoil rope is pulled from the start operation initiating position to execute the start operation for the engine, the crankshaft can be turned from the uniform position satisfactory for starting performance, whereby the engine can be started easily and stably.

According to the second aspect of the present invention, the notifying unit is the mark provided on the recoil rope at a position required to turn the crankshaft from a near-tip of the recoil rope in order to displace the piston from the vicinity of the compression stroke top dead center to the vicinity of the next exhaust stroke top dead stroke. Thus, electric power generation by the generator, the supply of the fuel, and the ignition by the ignition device can sequentially be performed to reduce the variations of the start executed by the recoil starter, facilitating the start of the engine. In addition, the engine starting system can be provided that can provide satisfactory starting performance by an inexpensive device without use of an expensive control unit for controlling the operation during the start of the engine.

According to the third aspect of the present invention, the engine starting system includes a fuel injector for injecting fuel into the 4-stroke engine and the control unit controls the fuel injector and the ignition device so that, after start operation of the engine is initiated, the fuel injector injects and supplies fuel to the engine at a predetermined position of the piston in preparation for ignition in the vicinity of the next compression stroke top dead center. Thus, when the fuel injector is used, both the ignition device and the fuel injector are operated by the electric power outputted by the generator. Also, electric power used by the control unit can be ensured by distributing power consumption by separating fuel injection timing from ignition timing, whereby the stable start control can be exercised.

According to the fourth aspect of the present invention, the engine starting method includes the step of setting an initial position of the crankshaft at a turning position of the crankshaft where the piston is located in the vicinity of the compression stroke top dead center; the start preparation step of turning the crankshaft from the initial position to a start operation initiating position so that the piston is displaced from the vicinity of the compression stroke top dead center to the next top dead center; and the start step of further turning the crankshaft from the start operation initiating position to cause the generator to generate electric power, supplying the fuel to the engine, and allowing the ignition device to ignite the fuel. Thus, the variations of engine-start can be reduced to improve the start performance.

DETAILED DESCRIPTION OF ILLUSTRATIVE EMBODIMENTS

It should be understood that only structures considered necessary for illustrating selected embodiments of the present invention are described herein. Other conventional structures, and those of ancillary and auxiliary components of the system, will be known and understood by those skilled in the art.

An illustrative embodiment of an engine starting system according to the present invention is described in detail with reference to the drawings.

Figure 1:
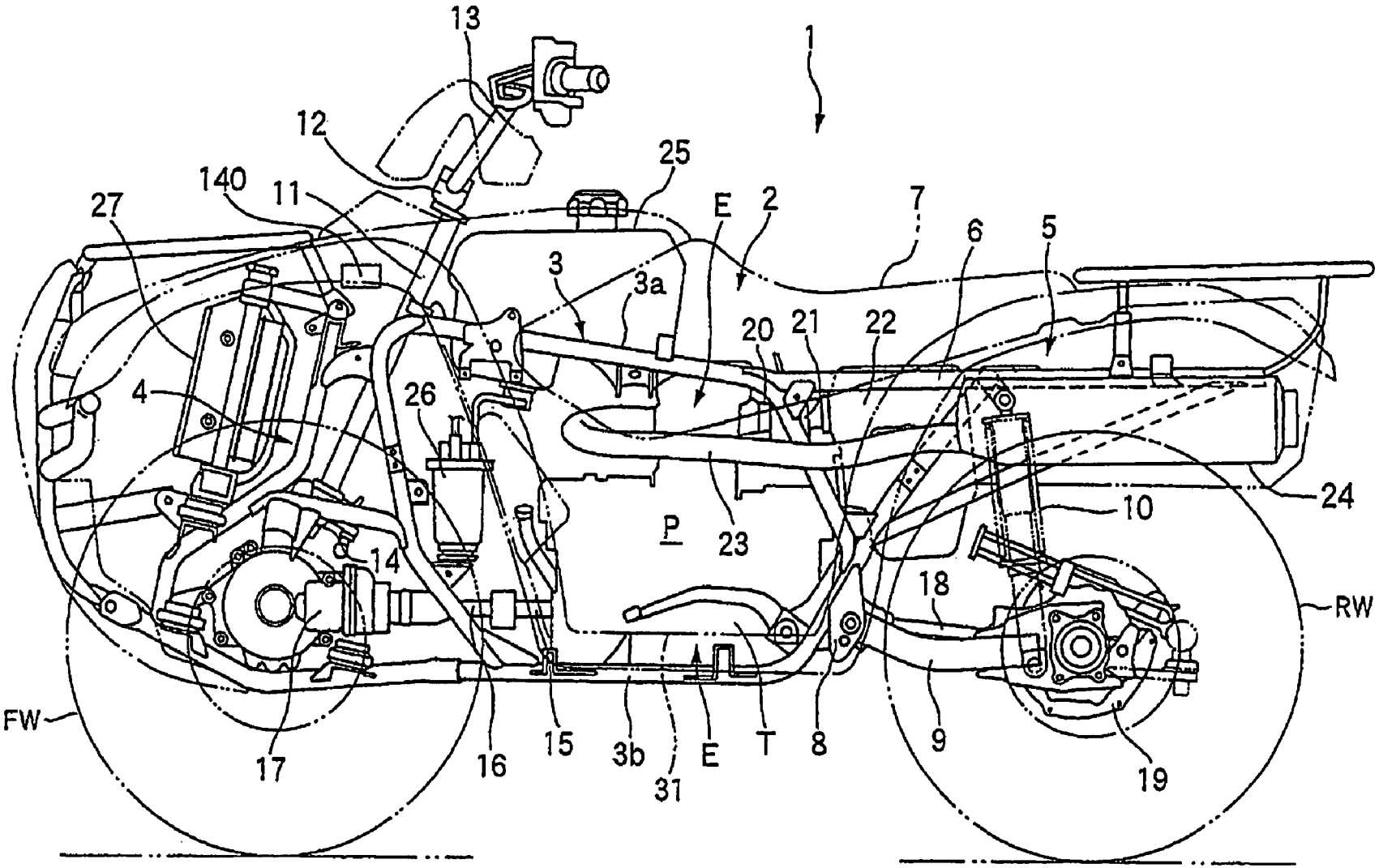
FIG. 1 is a side view of an all terrain vehicle having an engine having a starting device mounted thereon according to an embodiment of the present invention.
Figure 2:
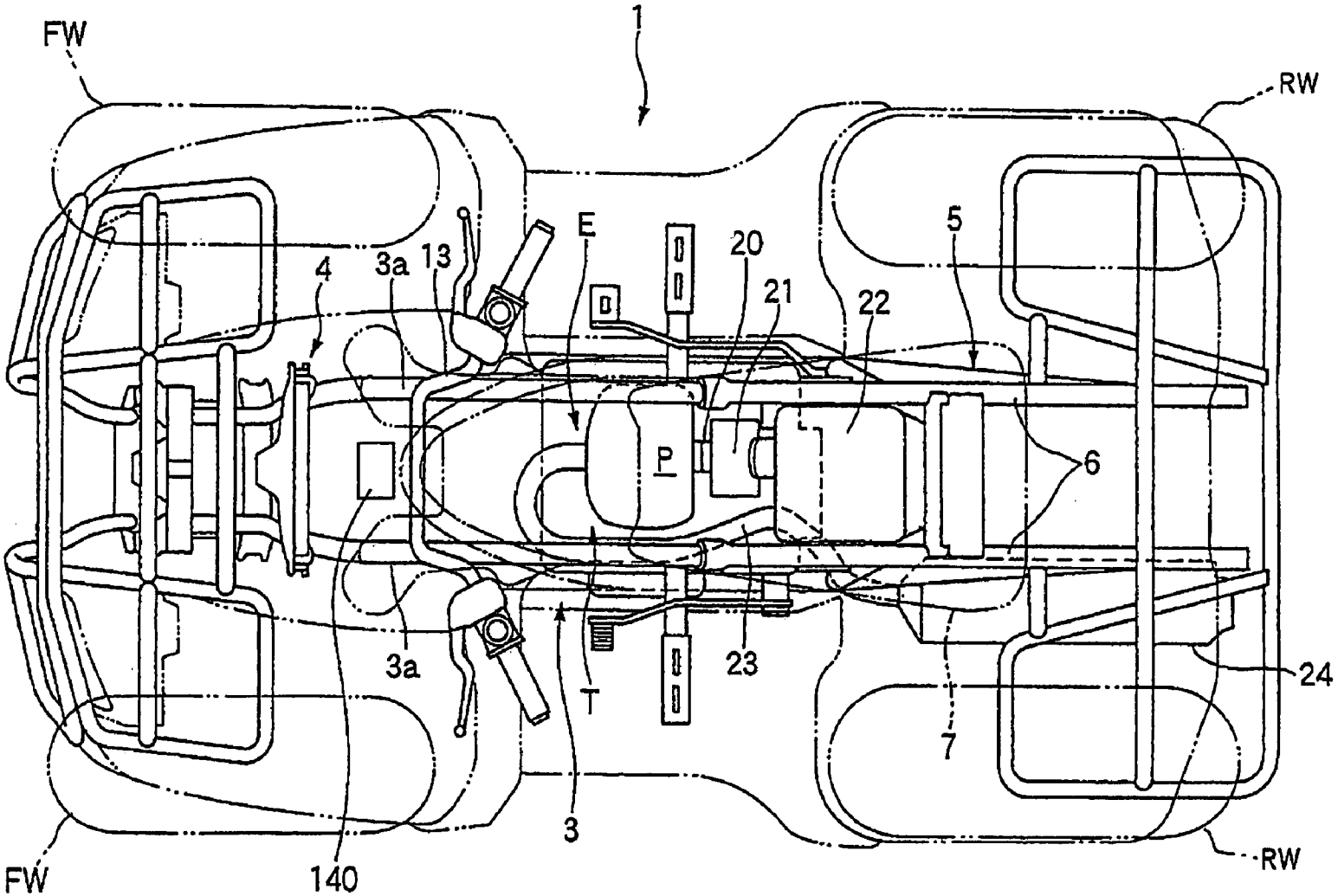
FIG. 2 is a top plan view of the all terrain vehicle shown in FIG. 1.

FIG. 1 is a side view of an all terrain vehicle (ATV) 1 having a water-cooled engine E (with a body cover and the like removed for clarity) mounted thereon with according to the embodiment. FIG. 2 is a top plan view of the ATV 1 of FIG. 1. It should be noted that the front, rear or back, left and right direction referred in the disclosure of the present invention are determined based on a normal vehicle advancing direction.

Referring to FIGS. 1 and 2, the all terrain vehicle 1 is a saddle-ride type four-wheeled vehicle in which a pair of left and right front wheels FW and rear wheels RW are suspended by the front and rear portions, respectively, of a body frame 2. The front and rear wheels FW, RW are attached with low-pressure balloon tires for irregular ground.

The body frame 2 is formed by joining a plurality of steel members together. The body frame includes a center frame portion 3, a front frame portion 4 and a rear frame portion 5. A power unit P, in which an engine E and a transmission unit T are integrally configured and accommodated in a crankcase 31, is mounted on the center frame portion 3. The front frame portion 4 is contiguous with the front portion of the center frame portion 3 and suspends the front wheels FW. The rear frame portion 5 is contiguous with the rear portion of the center frame portion 3 and has seat rails 6 adapted to support a seat 7.

The center frame portion 3 includes a pair of left and right upper pipes 3*a* and a pair of left and right lower pipes 3*b*. The front and rear portions of each of the upper pipe 3*a* are bent downward so as to form almost three sides of the center frame 3. The end portions of each of the respective upper pipes 3*a* are connected with each other via the lower pipe 3*b* formed at the other side. Thus, the center frame portion 3 is formed, which has a substantially rectangular shape when viewed in a side view. The left and right upper and lower pipes are connected with each other by cross members.

The lower pipe 3*b* extends reward and bends obliquely upwardly to form a rear portion to which a pivot plate 8 is secured. A swing arm 9 is swingably attached at a front end portion of the pivot plate 8. A shock absorber (also referred as a rear cushion member) 10 is interposed between the rear portion of the swing arm 9 and the rear frame portion 5. A rear final reduction gear unit 19 is provided at the rear ends of the swing arms 9. The rear wheels RW are suspended by the rear final reduction gear unit 19.

A cross member is spanned between the front end portions of the left and right upper pipes 3*a*. A steering column 11 is supported by the widthwise central portion of the cross member. A steering shaft 12 is steerably supported by the steering column 11. A steering handlebar 13 is connected to the upper end of the steering shaft 12. The steering shaft 12 is connected to a front wheel steering mechanism 14 at a lower end thereof.

Figure 3:
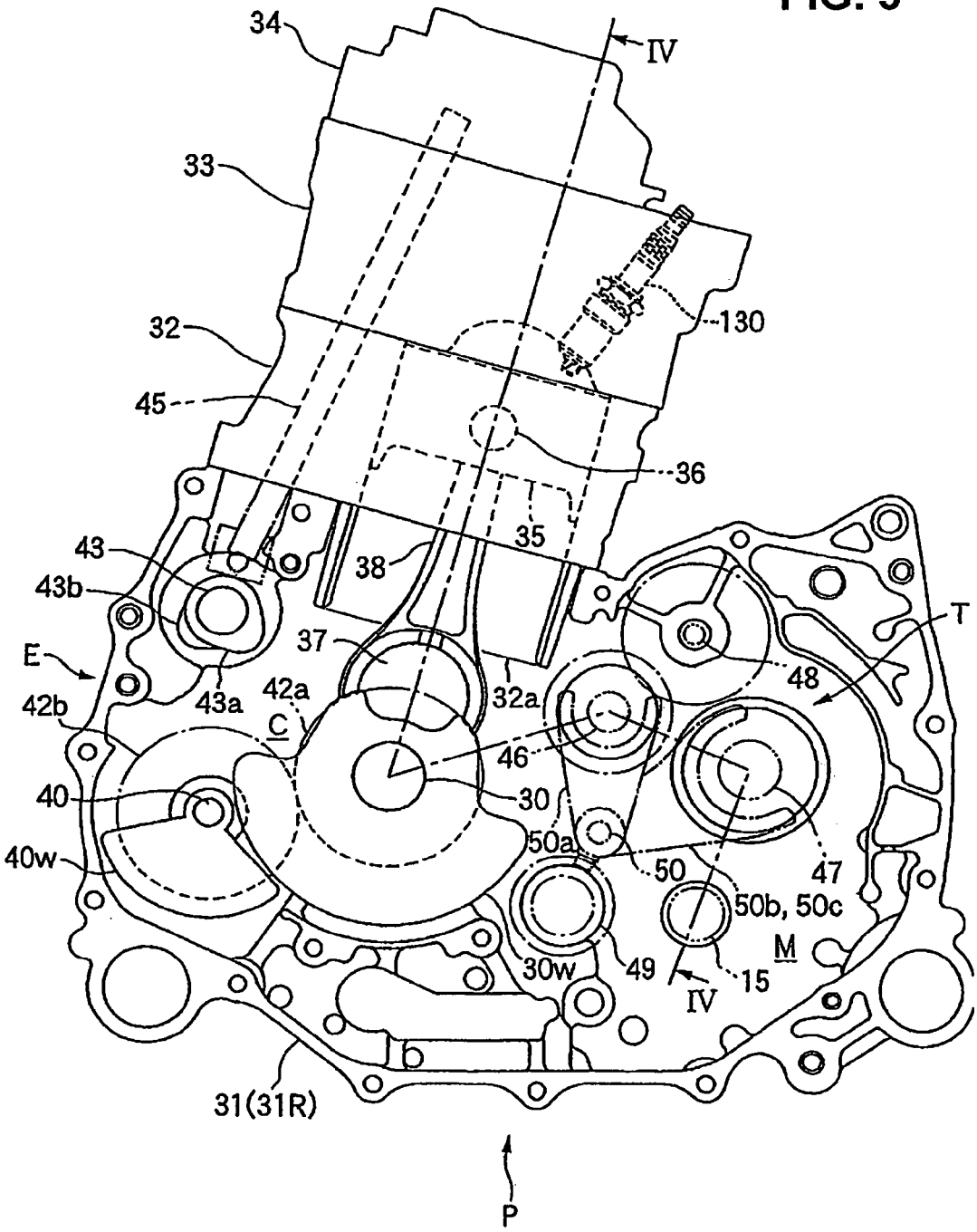
FIG. 3 is a front view of a power unit.

With additional reference to FIG. 3 which is a front view of the power unit, the engine E of the power unit P is a water-cooled single-cylinder 4-stroke engine, which is longitudinally mounted on the center frame portion 3, in which a crankshaft 30 of the engine is oriented in the back and forth direction of the vehicle body.

The transmission unit T of the power unit P is disposed in a transmission chamber M on the left side (the right side in FIG. 3) of a crank chamber C which journals a crankshaft 30 of the engine E. An output shaft 15 oriented in the back and forth direction protrudes forward and rearward from the transmission unit T. The rotational power of the output shaft 15 is transmitted from the front end thereof via a front drive shaft 16 and via a front final reduction gear unit 17 to the left and right front wheels FW. In addition, the rotational power of the output shaft 15 is transmitted from the rear end thereof to the left and right rear wheels RW via a rear drive shaft 18 and via the rear final reduction gear unit 19.

The engine E extends upward and leftward inclinely with respect to the vertical direction in such a manner that a cylinder block 32, a cylinder head 33 and a cylinder head cover 34 are stacked in this order on the crankcase 31. An intake pipe 20 extends rearwardly from the cylinder head 33, and is connected to an air cleaner 22 via a throttle body 21. An exhaust pipe 23 extends forward from the cylinder head 33, bending leftward and extending rearward, then further extends rearwardly on the left side of the air cleaner 22, and is joined to an exhaust muffler 24.

A fuel tank 25 is supported above the power unit P by the center frame portion 3 of the body frame 2. A fuel pump 26 is disposed below the front portion of the fuel tank 25. A radiator 27 is supported by the front frame portion 4 of the body frame 2.

Next, a configuration of the power unit P is described with reference to FIGS. 3 and 4. FIG. 3 is a front view of the power unit, and FIG. 4 is a cross-sectional view of a power transmission mechanism of the internal combustion engine taken along line IV-IV of FIG. 3.

The crankcase 31 forming the crank chamber C and transmission chamber M of the power unit P includes a front crankcase 31F and a rear crankcase 31R. The front and rear crankcases 31F, 31R are anteroposteriorly divided along a plane perpendicular to the crankshaft 30 which passes through the central axis of a cylinder bore of the cylinder block 32, and is oriented in the back and forth direction of the vehicle body.

Figure 4:
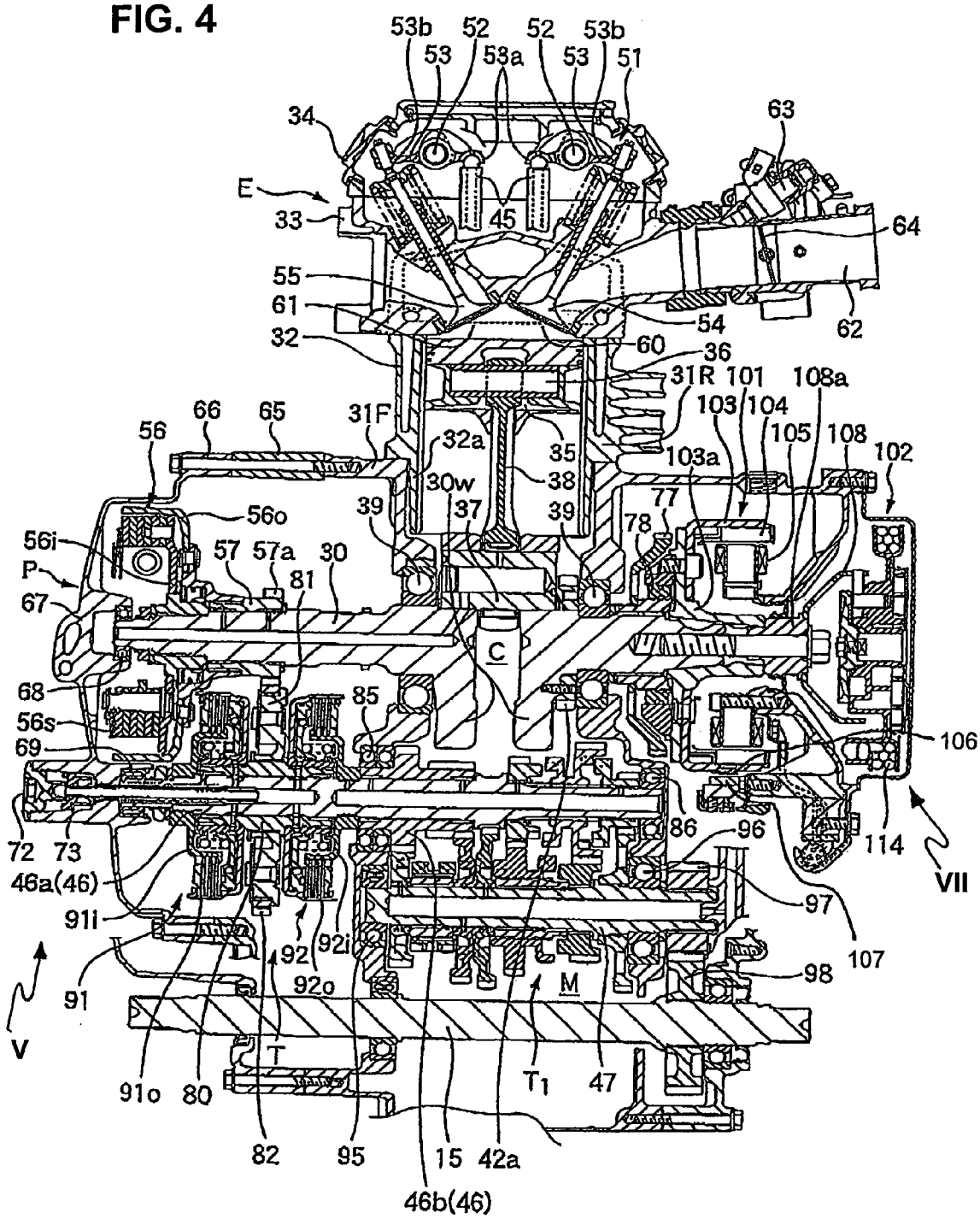
FIG. 4 is a cross-sectional view of the power unit taken along line IV-IV of FIG. 3.

As shown in FIGS. 3 and 4, a cylinder sleeve 32*a* extends from the cylinder block 32, and is fitted into the crankcase 31. A piston 35 is slidably fitted into the cylinder sleeve 32*a*. A crank pin 37 is spanned between a pair of front and rear crank webs 30*w*, 30*w* of the crankshaft 30, and is connected via a connecting rod 38 to a piston pin 36 provided in the piston 35. The crankshaft 30 is journaled by front and rear crankcase 31F, 31R via main bearings 39, 39 located in front and rear of the crank webs 30*w*, 30*w*.

As shown in FIG. 3, a balancer shaft 40 is located rightward below (leftward below in FIG. 3) and parallel to the crankshaft 30. The balancer shaft 40 is journaled at both ends by respective bearings (not shown) provided on the front crankcase 31F and the rear crankcase 31R. In addition, the balancer shaft 40 is centrally formed with a balancer weight 40*w*. A driven gear 42*b* is fitted to a rear portion of the balancer shaft 40, and meshes with a drive gear 42*a* fitted to the crankshaft 30.

A camshaft 43 of a valve operating system disposed substantially parallel to the crankshaft 30 is located diagonally right above the crankshaft 30. The camshaft 43 is journaled at both ends by respective bearings (not shown) provided on the front crankcase 31F and the rear crankcase 31R. The camshaft 43 is connected to the crankshaft 30 via a reduction mechanism (not shown) having a reduction ratio of ½. Rotation of the crankshaft 30 is transmitted to the camshaft 43. The lower end of a push rod 45 is in abutment against cam lobes 43*a*, 43*b* of the camshaft 43. The push rod 45 transmits a driving force to the valve operating system 51, which is operable to open and close an intake valve 54 and an exhaust valve 55.

As shown in FIG. 4, the valve operating system 51 includes rocker arms 53 each of which is swingably fitted to a rocker arm shaft 52. Both the end portions of each of the rocker arm shaft 52 are supported by the cylinder head cover 34. The upper end of the push rod 45 comes into abutment against one end 53*a* of the rocker arm 53. The other end 53*b* of the rocker arm 53 comes into abutment against and pushes the upper end of each of an intake valve 54 and an exhaust valve 55 disposed on the cylinder head 33. In this way, the crankshaft 30 is rotated twice to rotate the cam shaft 43 once. The rocker arm 53 swings around the rocker arm shaft 52 according to the lift set on each of the cam lobes 43*a*, 43*b* to press the intake valve 54 and the exhaust valve 55 to controllably open and close an intake port 60 and an exhaust port 61, respectively.

An intake pipe 62 communicating with the intake port 60 is joined to the cylinder head 33. A fuel injector 63 which injects fuel into the intake pipe 62 at predetermined timings is installed on the lateral surface of the intake pipe 62. A butterfly valve 64 is provided in the intake pipe 62 upstream of the fuel injector 63. An amount of air fed to the intake port 60 is controlled by opening or closing the butterfly valve 64.

An ignition device 130 (see FIG. 3) is installed on the upper portion of the cylinder head 33 to ignite air-contained fuel (mixed gas) fed from the intake pipe 62. The fuel injection timing of the fuel injector 63 and the ignition timing of the ignition device are controlled by an ECU 140 (FIGS. 1 and 2), a control unit configured to include a microcomputer.

The transmission unit T is disposed leftward (shown rightward in FIG. 3) of the crankshaft 30. A main shaft 46, a counter shaft 47 and an intermediate shaft 48 constitute a change-gear mechanism. A shift drum 49 is driven to shift gears, which is transmitted to an output shaft 15.

With reference to FIG. 4, a centrifugal start clutch 56 includes a clutch inner 56*i* serving as an input member rotating integrally with the crankshaft 30; a bowl-like clutch outer 56*o* serving as an output member surrounding the clutch inner 56*i* radially from outside; and a clutch shoe 56*s* serving as a centrifugal weight which is pivotally supported and radially externally swung by a centrifugal force to come into contact with the clutch outer 56*o* for establishing connection therewith. A boss portion of the clutch outer 56*o* is spline-fitted to a cylindrical gear member 57 rotatably carried on the crankshaft 30. Power from a drive gear 57*a* of the cylindrical gear member 57 is transmitted to the transmission unit T.

The main shaft 46 of the transmission unit T includes a first main shaft 46*a* and a second main shaft 46*b* partially and rotatably fitted with the outer circumference of the first main shaft 46*a*. The second main shaft 46*b* is journaled by the front crankcase 31F via a bearing 85 and the first main shaft 46*a* is journaled at a rear end by the rear crankcase 31R via a bearing 86.

An input sleeve 80 is rotatably fitted to the first main shaft 46*a* so as to be aligned with and forward of the second main shaft 46*b*. A disk plate 81 is fitted to the central portion of the input sleeve 80. A driven gear 82 provided on the outer circumference of the disk plate 81 meshes with the drive gear 57*a*.

A first shift clutch 91 and a second shift clutch 92 are respectively disposed forward and rearward of the disk plate 81. The first and second shift clutches 91, 92 are hydraulic multiple disk friction clutches each having substantially identical construction.

The first shift clutch 91 disposed on the front side is adjacent to the rear side of the start clutch 56. The bowl-like clutch outer 91*o* opening forwardly is integrally fitted to the input sleeve 80 from the front. The clutch inner 91*i* is integrally fitted to the first main shaft 46*a*. On the other hand, for the second shift clutch 92 disposed on the rear side, the bowl-like clutch outer 92*o* opening rearward is integrally fitted to the input sleeve 80 from the rear. The clutch inner 92*i* is integrally fitted to a portion of the second main shaft 46*b* extending forwardly from the bearing 85.

Accordingly, if the first shift clutch 91 is brought into engagement and the second shift clutch 92 into disengagement, the power inputted to the driven gear 82 is transmitted to the first main shaft 46*a* via the first shift clutch 91 in contrast, if the first shift clutch 91 is brought into disengagement and the second shift clutch 92 into the engagement, the power transmitted to the driven gear 82 is transmitted to the second main shaft 46*b* via the second shift clutch 92.

The counter shaft 47 (and the intermediate shaft 48) journaled by the bearings 95, 96 extends parallel to a portion of the first and second main shafts 46*a*, 46*b* extending in the transmission chamber M. A shift gear train group T1 which is a set of gears setting transmission stages is configured between the counter shaft 47 and the portion of the first and second main shafts 46*a*, 46*b*. The gears of the first main shaft 46*a* form first, third and fifth transmission stages through the first shift clutch 91 and the gears of the second main shaft 46*b* form second, fourth and reverse transmission stages.

A drive gear 97 is fitted to the rear end of the counter shaft 47 which protrudes rearwardly from the rear crankcase 31R. A driven gear 98 is fitted to the output shaft 15 disposed parallel to the counter shaft 47. The drive gear 97 meshes with the driven gear 98. Accordingly, the power reduced in speed is transmitted to the output shaft 15.

As shown in FIG. 3, a shift drum 49 is turnably spanned between the front crankcase 31F and the rear crankcase 31R. Respective shift pins of shift forks 50*a*, 50*b*, 50*c* slidably supported by a guide shaft 50 are each fitted to a corresponding one of three shift grooves formed in the outer circumferential surface of the shift drum 49. The shift drum 49 is turned to axially move the shift fork 50*a* while being guided by the corresponding shift groove, whereby the shift fork 50*a* axially moves a shifter on the main shaft 46. In addition, the shift forks 50*b*, 50*c* axially move the shifter on the counter shaft 47. In this way, a set of meshing sift gears is changed.

A rear mating surface of the front crankcase 31F is superposed on and fastened to a front mating surface of the rear crankcase 31R. The crank webs 30*w* of the crankshaft 30, the balancer weight 40*w* of the balancer shaft 40, the cam lobes 43*a*, 43*b* of the cam shaft 43, and the shift gear train group T1 are accommodated in the crankcase 31. In this way, the crankcase 31 is configured.

A front case cover 66 is disposed on the front crankcase 31F from the front via a spacer 65. The spacer 65 is an extension member which is formed by forwardly extending a circumferential edge portion of the front surface of the front crankcase 31F. This spacer 65 is formed with an oil pump unit for dry sump type lubricating system (not shown) and with a portion of an oil tank (not shown).

Figure 5:
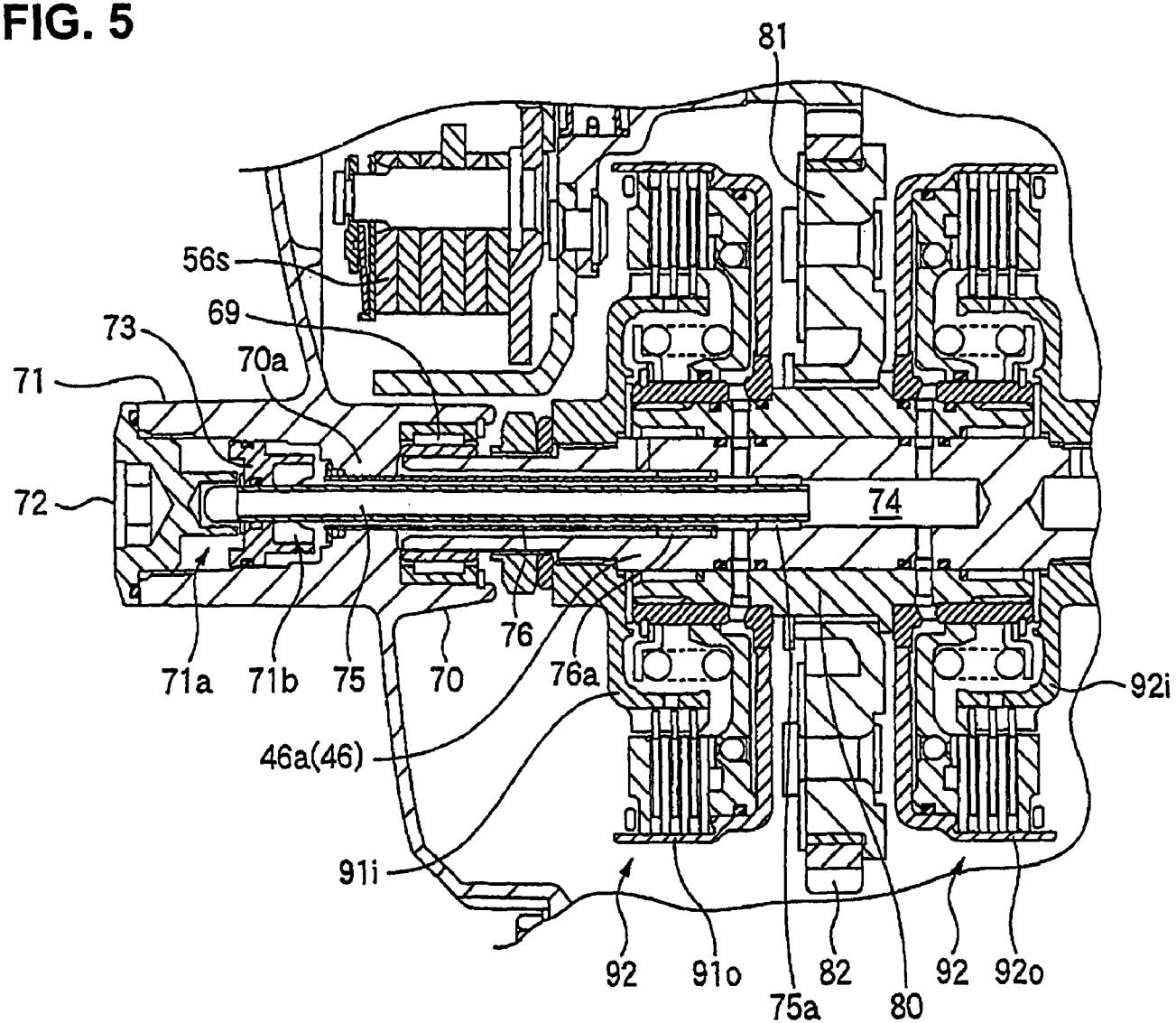
FIG. 5 is an enlarged cross-sectional detail view of a portion of FIG. 4 indicated with the numeral V.

A bearing 68 that journals the front end of the crankshaft 30 and a bearing 69 that journals the front end of the first main shaft 46*a* are attached to a front wall 67 of the front case cover 66. As shown in FIG. 5, a bearing cylindrical portion 70 of the front wall 67 which supports a bearing 69 extends outwardly to form an outside cylindrical portion 71. The outside cylindrical portion 71 is internally isolated from the inside of the bearing cylindrical portion 70 by a partition wall 70*a*. The front end opening of the outside cylindrical portion 71 is closed by a lid member 72 forming an inner space therebetween. The inner space is partitioned into a front chamber 71*a* and a rear chamber 71*b* by a partition member 73.

On the other hand, the front portion of the first main shaft 46*a* is bored with a shaft hole 74 which extends from the front end to a position corresponding to the second shift clutch 92. An elongated communication internal-tube 75 extending from the front chamber 71*a*, is passed through the partition member 73 and inserted into the shaft hole 74.

In addition, the communication internal-tube 75 is disposed so as to terminate at an intermediate position between the first shift clutch 91 and the second shift clutch 92. The rear end of the communication internal-tube 75 is supported by the shaft hole 74 via a seal member 75*a*. A short communication external-tube 76 is disposed coaxially with and around the communication internal-tube 75. This communication external-tube 76 is fitted at a front end into the partition wall 70*a*, inserted into the shaft hole 74, and is supported at a rear end by the shaft hole 74 via a seal member 76*a*.

Hydraulic pressure is supplied from respective hydraulic control valve units (not shown) to the front chamber 71*a* and rear chamber 71*b* of the external cylindrical portion 71. If the hydraulic pressure is supplied to the rear chamber 71*b*, pressurized oil is passed through between the short communication external-tube 76 and the communication internal-tube 75, and is supplied from the front of the seal member 75*a* to the first shift clutch 91 for engagement.

When the hydraulic pressure is supplied to the front chamber 71*a*, pressurized oil is passed through the elongate communication internal-tube 75, and supplied from the shaft hole 74 rearwardly of the seal member 75*a* to the second shift clutch 92 for engagement.

The first, third and fifth transmission stages of the respective gears on the first main shaft 46*a* and the second, fourth and reverse transmission stages of the respective gears on the second main shaft 46*b* are alternately switched via the first shift clutch 91 and via the second shift clutch 92, respectively, by controlling the hydraulic control valve unit. Thus, shifting of gears can be executed smoothly.

A generator 101, a recoil starter 102 which is an engine starting device and a start driven gear 77 are attached to the rear end portion of the crankshaft 30. The start driven gear 77 is adapted to transmit the rotation of a starter motor (not shown) attached to the rear crankcase 31R, to the crankshaft 30. The driven gear 77 is connected to a flywheel 103 of the generator 101 via a one-way clutch 78.

A boss portion 103*a* of the bowl-like formed flywheel 103 is fixedly fitted to a tapered portion formed at the rear end of the crankshaft 30 so as to be rotated together with the crankshaft 30. A plurality of ferrite magnets 104 are secured to the bowl-like formed inner circumferential surface of the flywheel 103 at predetermined circumferential intervals. Coils 105 secured to the rear crankcase 31R are each arranged on the radially inside of the ferrite magnets 104 so as to face a corresponding one of the ferrite magnets 104. The ferrite magnets 104 and coils 105 constitute the generator 101. In short, the crankshaft 30 is rotated to cause the magnetic force of the ferrite magnets 104 to cross the coils 105, which thereby generates an electromotive force.

Figure 6:
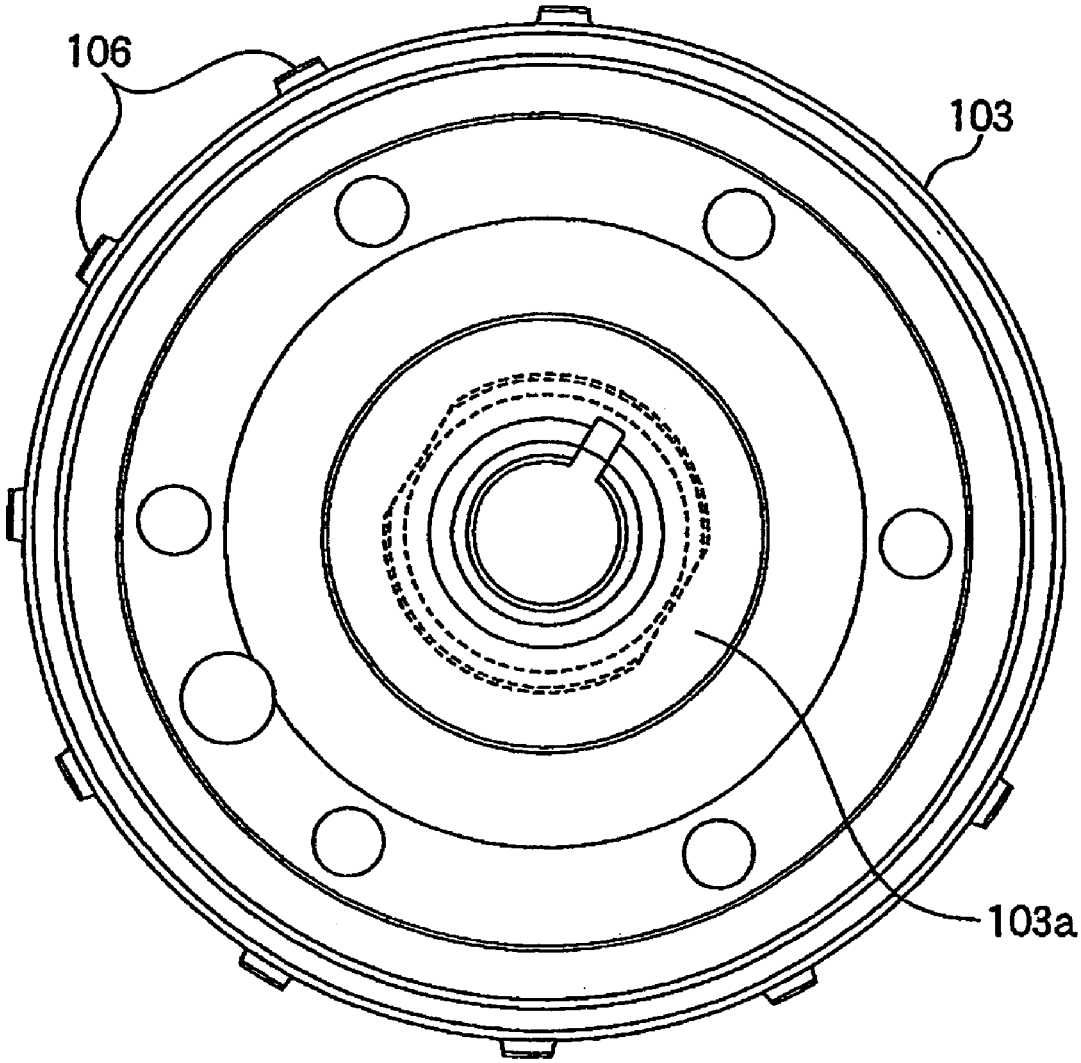
FIG. 6 is a side view of a flywheel of the power unit.

As shown in FIG. 6, a plurality of (nine in the embodiment) projections 106 are arranged on the outer circumferential surface of the flywheel 103 in a predetermined, circumferentially angular range so as to be spaced apart from each other at given intervals (e.g., 30°-intervals).

A pulse sensor 107 is disposed circumferentially externally of the rotational trajectory of the projections 106. The pulse sensor 107 detects each projection 106 that passes the vicinity thereof and sends the detection signal to a control unit. The control unit detects the phase of the crankshaft 30 based on the detection signal and controls the fuel injection timing of the fuel injector 63, the ignition timing of the ignition device and the like.

Figure 7:
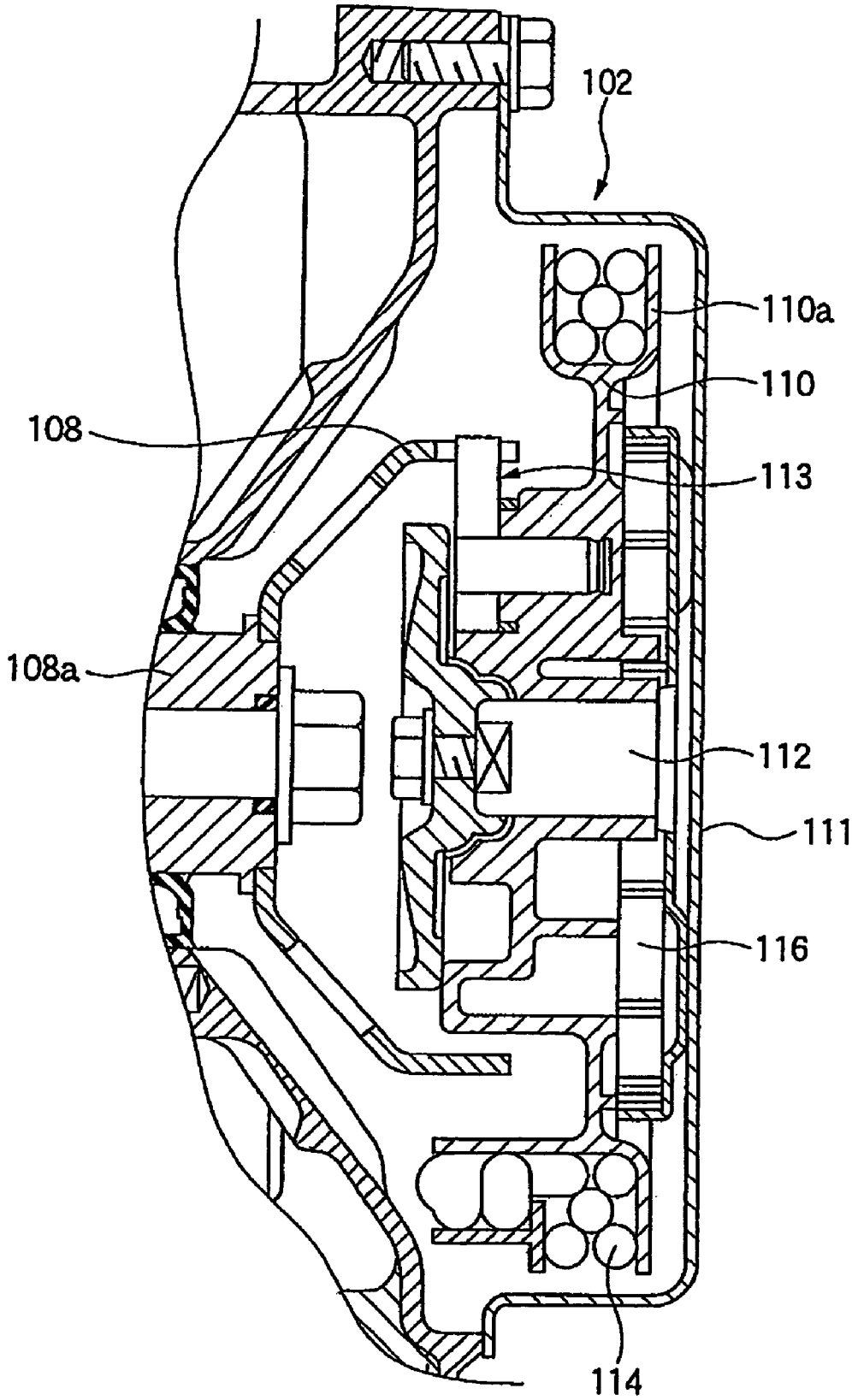
FIG. 7 is an enlarged cross-sectional detail view of a portion of FIG. 4 indicated with the numeral VII.

A boss portion 108*a* of a bowl-like recoil pulley 108 in the recoil starter 102 is secured to the boss portion 103*a* of the flywheel 103 so as to be rotated integrally with the crankshaft 30. As shown in FIG. 7, the reel 110 is turnably fitted on a support shaft 112 of a recoil starter case 111 secured to the rear crankcase 31R.

The support shaft 112 and the crankshaft 30 are disposed on the same axis. A ratchet mechanism 113 is interposed between the bowl-like recoil pulley 108 and the reel 110. The ratchet mechanism 113 is configured to transmit the turn of the reel 110 in one direction, the turning direction encountered when a recoil rope 114 (described later) is pulled to the recoil pulley 108, and not to transmit the turn of the reel 110 in the other direction thereto due to the idle turn of the reel 110.

Figure 8:
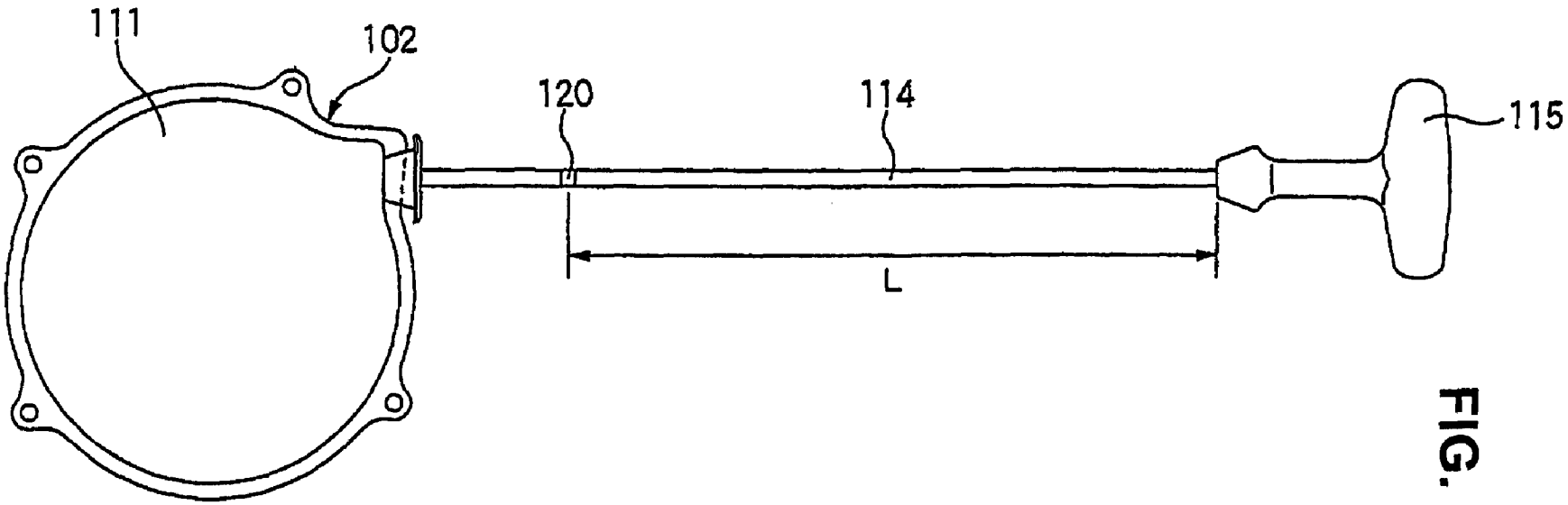
FIG. 8 is a simplified side plan view of a recoil rope having a mark formed thereon.

The recoil rope 114 is wound a plurality of times around a pulley portion 110*a* of the reel 110 formed in a general U-shape in cross-section and has a tip to which a knob 115 is secured (see FIG. 8). The knob 115 is disposed externally of the recoil starter case 111 so as to be manually operable. A return spring 116 is interposed between the reel 110 and the recoil starter case 111.

When the reel 110 is released, the return spring 116 turns the reel 110 in the direction reverse to that encountered when the recoil rope 114 is manually operated, and restores it to the original position. In this case, the turn of the reel 110 in the reverse direction is not transmitted to the crankshaft 30 due to the operation of the ratchet mechanism 113.

A notifying unit having a mark 120 serving as an informing indicator (informing means) is attached to the middle of the recoil rope 114. The mark 120 may be a tape wound around the recoil rope 114 or directly colored on the rope 114. A rope-length L (also referred as a predetermined length L) from the vicinity of the tip of the recoil rope 114 to the position attached with the mark 120 is set to a length that is required to turn the crankshaft 30 from the turning position of the crankshaft 30 encountered when the piston 35 of the engine E is located in the vicinity of the compression stroke top dead center, to the turning position of the crankshaft 30 suitable for starting pulling the recoil rope 114 in order to initiate the start operation of the engine E.

In other words, the rope-length L is set at the circumferential length of the reel 110 encountered when the crankshaft 30 is turned to move the piston 35 from the vicinity of the compression stroke top dead center to the vicinity of the next exhaust stroke top dead center.

The Engine Starting Method

Figure 9:
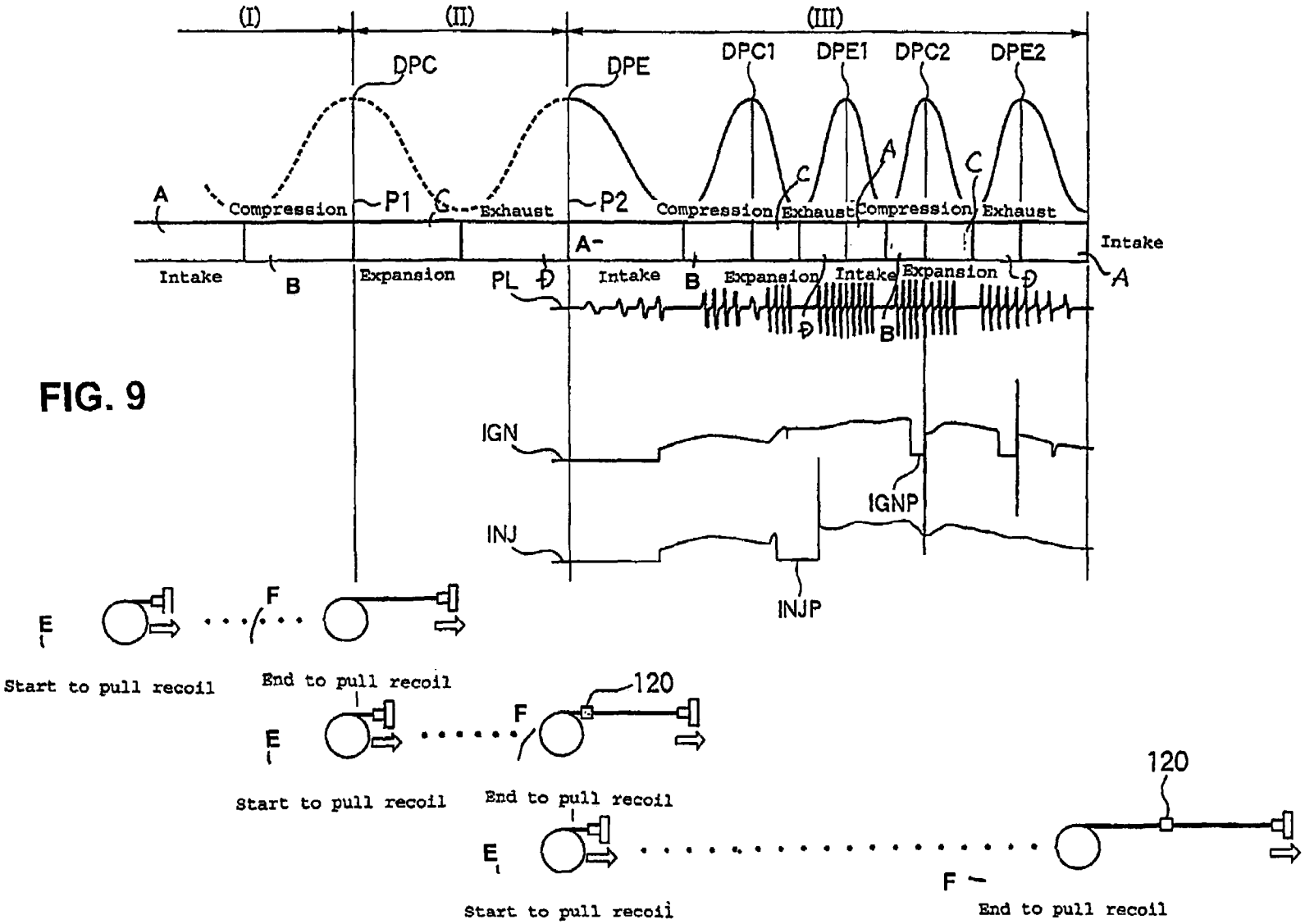
FIG. 9 is a conceptual diagram illustrating steps for starting an engine equipped with a fuel injector, using the starting system of the present invention.

A method of starting the 4-stroke engine using the engine starting system of the present invention is described below. FIG. 9 is a conceptual diagram illustrating steps for starting the engine equipped with the fuel injector by applying the recoil starter 102.

In order to start the 4-stroke engine E equipped with the recoil starter 102, the recoil rope 114 is pulled to turn the crankshaft 30, causing the generator 101 to generate electric power. After the electric power is stabilized, fuel is injected from the fuel injector 63 at a predetermined timing while controlling the various portions by the ECU. Then, mixed gas is ignited by the ignition device to start the engine E.

However, the turning position of the crankshaft 30 of the 4-stroke engine E in a resting state differs depending on the state where the engine E is stopped, that is, the turning position is irregular. Even if the recoil rope 114 of the recoil starter 102 is pulled from this state, the engine E does not smoothly start in some cases because the initiate position of the start differs each time. In such cases, the recoil rope 114 has to be pulled a number of times.

The engine starting method according to the present invention includes the following steps, which are discussed with reference to FIG. 9.

(I) Phase Alignment Step

Referring to FIG. 9, first, the recoil rope 114 of the recoil starter 102 is slowly pulled to turn the crankshaft 30 located at a position where the piston 35 is stopped in any of the strokes, to an initial position P1, where the piston is located near the compression stroke top dead center DPC. Since resistance resulting from compressed air (mixed gas) is applied to the crankshaft 30 in the vicinity of the compression stroke top dead center DPC, turning torque is increased. Thus, since a large force is applied to the recoil rope 114, a user can easily recognize the compression stroke top dead center DPC.

After the crankshaft 30 is turned to the initial position P1, the recoil rope 114 is returned to the original position. While the crankshaft 30 remains stopped at the initial position P1 due to the operation of the ratchet mechanism 113 and return spring 116, the reel 110 is turned to wind the recoil rope 114 around the pulley portion 110*a*.

Incidentally, the initial position P1 is preferably set at a turning position where the compression stroke top dead center DPC is slightly exceeded when the recoil rope 114 is released.

(II) Start Preparation Step

Next, the recoil rope 114 is again pulled to the position where the mark 120 is attached to the recoil rope 114. That is, the recoil rope is pulled one circumferential length of the reel 110 of the recoil starter 102. The position attached with the mark 120 is set at the circumferential length of the reel 110 required to turn the crankshaft 30 from the turning position of the crankshaft 30 encountered when the piston 35 of the engine E is located near the compression stroke top dead center DPC, to the turning position of the crankshaft 30 suitable to start pulling the recoil rope 114 to initiate the start operation of the engine E (i.e., a start operation initiating position P2 of the crankshaft 30 encountered when the piston 35 is located near the exhaust stroke top dead center DPE which is the next top dead center).

Thus, the rotational position of the crankshaft 30 is set at a position suitable for initiating the start operation. Then, the recoil rope 114 is returned to the original position.

(III) Starting Step

The recoil rope 114 is again pulled with great force to turn the crankshaft 30, the flywheel 103 is rotated and the generator 101 starts to generate electric power. This electric power starts up the ECU, which starts to control the various portions.

In FIG. 9, a symbol PL denotes a rotational signal of the crankshaft 30 outputted from the pulse sensor 107, INJ denotes a fuel injection command signal outputted from the ECU and IGN denotes an ignition command signal IGN outputted from the ECU.

When the crankshaft 30 reaches a predetermined position that exceeds the compression stroke top dead center DPC which is first top dead center from the start operation initiating position P2, fuel is injected from the fuel injector 63 into the intake pipe 62 at this timing on the basis of a fuel injection command pulse signal INJP from the ECU.

The mixed gas generated in the intake pipe 62 during the subsequent intake stroke is sucked and compressed during the compression stroke. Then, the mixed gas is ignited by the ignition device immediately before the compression stroke top dead center DPC on the basis of an ignition command pulse signal IGNP from the ECU. Then, the expansion stroke is started by the combustion of the mixed gas to apply a rotational force to the crankshaft 30. Next, the combustion gas is discharged to the outside during the exhaust stroke, starting the engine E.

As described above, according to the engine starting device (the recoil starter 102) of the embodiment, the recoil rope 114 is attached with the mark 120 at a length-position required to turn the crankshaft 30 from the compression stroke top dead center DPC to the start operation initiating position P2 suitable to initiate the start operation of the 4-stroke engine E. Thus, the start operation for the engine E can be performed from the start operation initiating position P2 that constantly provides satisfactory starting performance, whereby the engine E can be started easily and stably.

Incidentally, the present invention is not limited to the embodiment described above and can arbitrarily be modified or reformed.

Figure 10:
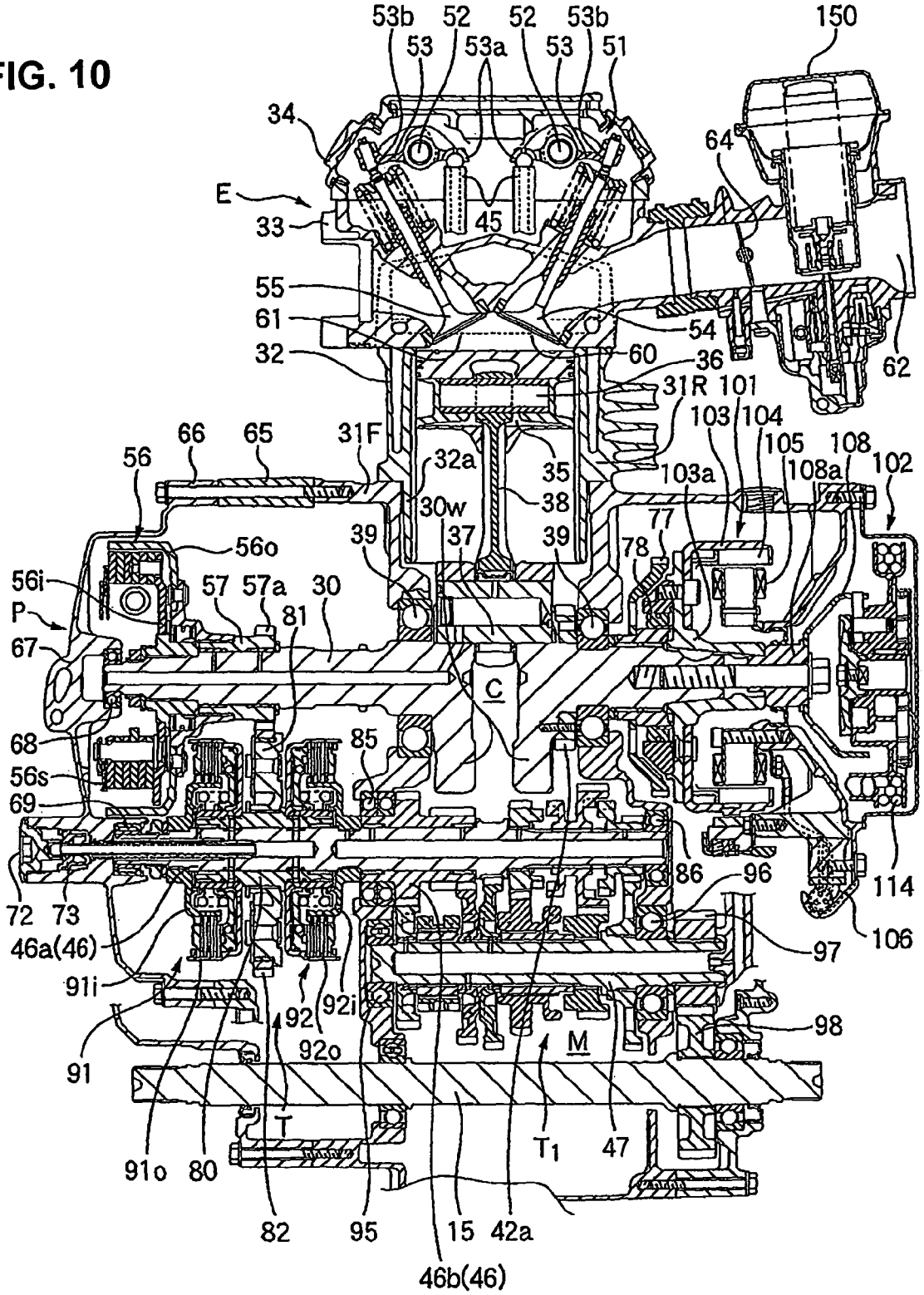
FIG. 10 is a cross-sectional view of an engine equipped with a carburetor, according to a modified example of the invention.

For example, the embodiment describes the 4-stroke engine E equipped with the fuel injector 63. However, the present invention can be applied to a 4-stroke engine equipped with a carburetor 150 shown in FIG. 10.

More specifically, the 4-stroke engine equipped with the carburetor is different from the engine E equipped with the above-mentioned fuel injector 63 in the following respect. A butterfly valve 64 is opened or closed to adjust flow, fuel from the carburetor 150 is mixed with air flowing in the intake pipe 62, and the mixture is supplied to the engine E.

Figure 11:
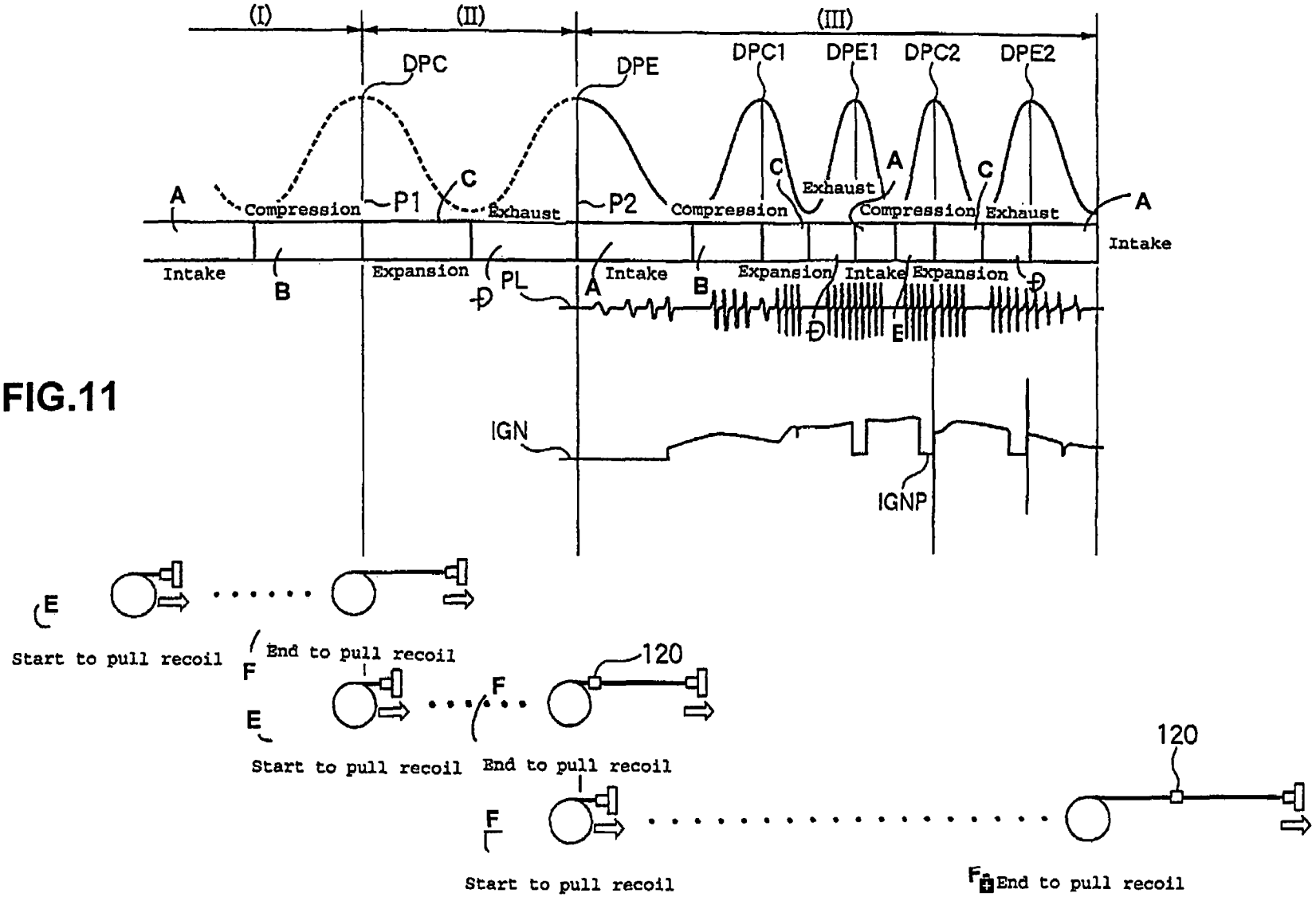
FIG. 11 is a conceptual diagram illustrating steps for starting the engine equipped with the carburetor, using the starting system of the present invention.

With such a configuration, as shown in FIG. 11, also the start operation of the engine E equipped with the carburetor 150 is performed in just the same way as that of the engine E equipped with the fuel injector 63. In other words, the steps including the phase alignment step (I), the start preparation step (II), and the starting step (III) are performed in this order and fuel supply control exercised by the ECU is eliminated.

The above embodiment describes the 4-stroke engine mounted on the all terrain vehicle by way of example. However, the present invention is not limited to such an engine. The invention can be applicable to engines used for e.g., agriculture, ships and other applications as long as they are 4-stroke engines. This provides the same effect.

In addition, the engine starting method of the present invention is not limited to the recoil starter and includes manual operation such as e.g. a kick starter.

In the present embodiment, the mark 120 is attached to the length-position of the recoil rope required to turn the crankshaft 30 from the initial position P1 to the start operation initiating position P2. However, the invention is not limited to this. A predetermined length position of the recoil rope may be informed to the user by other informing means such as sound device which indicates signal by producing a sound when the predetermined length of recoil rope is reached. Also a light producing device or the like may be used for providing indication about the predetermined length of the recoil rope.

Further, the engine starting method of the present invention may be constituted such that a control unit controls the step for setting the crankshaft at the initial position and the step for turning the crankshaft to the start operation initiating position. For example, at the time of stopping the engine, the crankshaft may be controlled to stop at the start operating position through such steps.

In other words, although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. An engine starting system for a 4-stroke engine having a piston and a crankshaft, said engine starting system comprising:

a recoil starter comprising a reel and a recoil rope wound around the reel;

a ratchet mechanism, said recoil starter being connected to the crankshaft via said ratchet mechanism for transmitting a one-directional rotation of the recoil starter to the crankshaft;

a generator for generating electric power in conjunction with rotation of the crankshaft by the recoil starter;

a control unit; and an ignition device controlled by the control unit using the electric power from the generator as a power supply to generate a spark in the vicinity of a compression stroke top dead center orientation of the piston;

wherein said 4-stroke engine is adapted to be started by pulling the recoil rope to rotate the crankshaft, and wherein said engine starting system further comprises:

a notifying unit for notifying a length of the recoil rope required to turn the crankshaft from a turning position of the crankshaft, encountered when the piston is located in the vicinity of the compression stroke top dead center, to a turning position of the crankshaft adapted to initiate a start operation of the engine.

2. An engine starting system according to claim 1, wherein the notifying unit comprises a mark provided on the recoil rope at a position providing a predetermined length of the recoil rope required to turn the crankshaft from a near-tip of the recoil rope in order to displace the piston from the vicinity of the compression stroke top dead center to a next exhaust stroke top dead center.

3. An engine starting system according to claim 1, wherein the engine comprises a cylinder and a fuel injector for injecting fuel into said of the engine; and wherein said control unit controls the fuel injector and the ignition device so that, after the start operation of the 4-stroke engine is initiated, the fuel injector injects and supplies fuel to the cylinder of the 4-stroke engine at a predetermined position of the piston, for ignition in the vicinity of the next compression stroke top dead center.

4. An engine starting system according to claim 2, wherein said 4-stroke engine comprises a cylinder and a fuel injector for injecting fuel into said cylinder the 4-stroke engine; and wherein the control unit controls the fuel injector and the ignition device so that, after start operation of the 4-stroke engine is initiated, the fuel injector injects and supplies fuel to the cylinder of the 4-stroke engine at a predetermined position of the piston, for ignition in the vicinity of the next compression stroke top dead center.

5. An engine starting system according to claim 1, wherein the notifying unit comprises a mark disposed on the recoil rope at a position providing a predetermined length of the recoil rope, and wherein said predetermined length is substantially equal to a circumferential length of said reel.

6. An engine starting system according to claim 1, wherein said notifying unit comprises a mark formed on the recoil rope, and wherein said mark is one of a tape wound around the recoil rope and direct coloring of a portion of the rope.

7. A method of starting a 4-stroke engine having a piston and a crankshaft, a recoil starter having a recoil rope for pull-starting the engine, a generator for generating electric power in conjunction with turning of the crankshaft, a control unit, a fuel injector controlled by the control unit for supplying fuel, and an ignition device controlled by the control unit using the electric power outputted by the generator as a power supply to generate a spark in a vicinity of compression stroke top dead center of the piston, said engine being started by turning the crankshaft, said engine starting method comprising the steps of:

setting, with a first pull of the recoil starter, an initial position of the crankshaft at a turning position of the crankshaft where the piston is located in a vicinity of the compression stroke top dead center;

turning the crankshaft, with a second pull, from the initial position to a start operation initiating position so that the piston is displaced from the vicinity of the compression stroke top dead center to a next top dead center, said start operation initiating position being indicated by a mark on the recoil rope; and further turning the crankshaft, with a third pull, beyond the start operation initiating position to cause the generator to generate electric power, said control unit to supply fuel to the engine, and to allow the ignition device to ignite the fuel.

8. An engine starting method of claim 7, wherein said engine comprises a recoil starter having a reel and a recoil rope wound around said reel, said recoil starter being connected to the crankshaft via a ratchet mechanism for transmitting a one-directional turn of the recoil starter to the crankshaft; and wherein said setting said initial position of the crankshaft at said turning position of the crankshaft comprises the method step of slowly pulling the recoil rope of the recoil starter to turn the crankshaft to said initial position by recognizing a force applied recoil rope, wherein said force increase as the piston reaches said compression stroke top dead center.

9. An engine starting method of claim 7, wherein said engine comprises a recoil starter including a reel, a recoil rope wound around said reel, and a knob attached to a free end of the recoil rope; said recoil starter being connected to the crankshaft via a ratchet mechanism for transmitting a one-directional turn of the recoil starter to the crankshaft; said recoil rope having a mark formed thereon providing a predetermined length of the coil rope between said mark and said knob attached to said recoil rope;

wherein said turning the crankshaft from the initial position to said start operation initiating position comprises the method steps of pulling the recoil rope by one circumferential length of the reel to a position where the mark is visible, and subsequently releasing the recoil rope.

10. An engine starting method of claim 7, wherein said engine comprises a recoil starter including a reel, a recoil rope wound around said reel, and a knob attached to a free end of the recoil rope; said recoil starter being connected to the crankshaft via a ratchet mechanism for transmitting a one-directional turn of the recoil starter to the crankshaft; said recoil rope having a mark formed thereon providing a predetermined length of the coil rope between said mark and said knob attached to said recoil rope;

wherein said further turning the crankshaft from the start operation initiating position comprises the method step of pulling the recoil rope with a force using the knob to turn the crankshaft and the generator so as generate electric power.

11. An engine starting method of claim 7, wherein said next top dead center is an exhaust stroke top dead center.

12. An engine starting system for a 4-stroke engine having a piston and a crankshaft, said engine starting system comprising:

a recoil starter having reel and a recoil rope wound around said reel, and a ratchet mechanism operatively mounted on said reel; said recoil starter being operatively connected to the crankshaft via said ratchet mechanism for transmitting a one-directional turn of the recoil starter to the crankshaft; said engine being configured to start by pulling the recoil rope turning the crankshaft;

a generator for generating electric power in conjunction with turning of the crankshaft by the recoil starter;

an ignition device controlled by a control unit using the electric power outputted by the generator to generate a spark of fuel-air mixture in the vicinity of a compression stroke top dead center of the piston; and a mark disposed on said recoil rope providing a predetermined length of the recoil rope required to turn the crankshaft from a turning position of the crankshaft encountered when the piston is located in the vicinity of said compression stroke top dead center to a turning position of the crankshaft adapted to initiate a start operation of the 4-stroke engine.

13. An engine starting system according to claim 12, wherein said predetermined length of said recoil rope is substantially equal to a circumferential length of said reel.

14. An engine starting system according to claim 12, wherein said predetermined length of the recoil rope is required to turn the crankshaft from a near-tip of the recoil rope in order to displace the piston from the vicinity of the compression stroke top dead center to a next exhaust stroke top dead center.

15. An engine starting system according to claim 12, wherein said mark is one of a tape wound around the recoil rope and direct coloring of a portion of the rope.

16. An engine starting system according to claim 12, wherein said 4-stroke engine comprises a cylinder and a fuel injector for injecting fuel into said cylinder the 4-stroke engine; and wherein said control unit controls the fuel injector and the ignition device so that, after start operation of the 4-stroke engine is initiated, the fuel injector injects and supplies fuel to the cylinder of the 4-stroke engine at a predetermined position posterior of first top dead center the piston exceeding for ignition in the vicinity of the next compression stroke top dead center.

17. An engine starting system according to claim 12, wherein said 4-stroke engine comprises a cylinder and a carburetor for injecting a fuel-air mixture into said cylinder of the 4-stroke engine; and wherein the control unit controls the carburetor and the ignition device so that, after start operation of the 4-stroke engine is initiated, the carburetor injects and supplies fuel-air mixture to the cylinder of the 4-stroke engine at a predetermined position posterior of first top dead center the piston for ignition in the vicinity of the next compression stroke top dead center.

18. An engine starting system according to claim 14, wherein said 4-stroke engine comprises a cylinder and a carburetor for injecting fuel-air mixture into said cylinder the 4-stroke engine; and wherein said control unit controls the carburetor and the ignition device so that, after start operation of the 4-stroke engine is initiated, the carburetor injects and supplies fuel-air mixture to the cylinder of the 4-stroke engine at a predetermined position of the piston for ignition in the vicinity of the next compression stroke top dead center.

19. An engine starting system according to claim 12, said mark includes a sound-producing device for informing said predetermined length of said of recoil rope.

20. An engine starting system according to claim 12, said mark includes a light-producing device for informing said predetermined length of said of recoil rope.

* * * * *